United States Patent [19]

Sasaki

[11] Patent Number: 4,701,106

[45] Date of Patent: Oct. 20, 1987

[54] RADIAL-TYPE CERAMIC TURBINE ROTOR AND A METHOD FOR PRODUCING THE SAME

[75] Inventor: Shingo Sasaki, Kuwana, Japan

[73] Assignee: NGK Insulators, Ltd., Japan

[21] Appl. No.: 873,850

[22] Filed: Jun. 11, 1986

Related U.S. Application Data

[63] Continuation of Ser. No. 681,318, Dec. 13, 1984, abandoned.

[30] Foreign Application Priority Data

Dec. 27, 1983 [JP] Japan ..... 58-251881

[51] Int. Cl.[4] ..... F01D 5/34

[52] U.S. Cl. ..... 416/241 B; 416/244 R; 264/262; 425/129 R

[58] Field of Search ..... 416/241 B, 224 A, 244 R, 416/229, 214 R, 214 A, 239; 264/60, 261, 262; 156/293, 294; 425/129 R, 127, 117, 110, 218

[56] References Cited

U.S. PATENT DOCUMENTS

| | | | |
|---|---|---|---|
| 626,588 | 6/1899 | Bryant | 264/262 |
| 3,801,226 | 4/1974 | Bevan et al. | 416/241 |
| 3,887,411 | 6/1975 | Goodyear et al. | 156/89 |
| 3,887,412 | 6/1975 | Styhr et al. | 156/89 |
| 3,959,429 | 5/1976 | Benning | 264/261 |
| 4,096,120 | 6/1978 | Grunke | 264/60 |
| 4,147,468 | 4/1979 | Murakami et al. | 415/213 R |
| 4,248,813 | 2/1981 | Hattori et al. | 264/62 |
| 4,294,635 | 10/1981 | Hurley, Jr. | 156/89 |
| 4,368,166 | 1/1983 | Hinton et al. | 264/61 |
| 4,408,959 | 10/1983 | Long et al. | 416/241 B |

FOREIGN PATENT DOCUMENTS

| | | | |
|---|---|---|---|
| 254599 | 12/1962 | Australia | 416/244 |
| 737311 | 6/1966 | Canada | 264/262 |
| 679926 | 7/1939 | Fed. Rep. of Germany . | |
| 2604171 | 8/1977 | Fed. Rep. of Germany . | |
| 528068 | 11/1921 | France | 416/244 |
| 17593 | 5/1971 | Japan | 264/262 |
| 125302 | 9/1980 | Japan | 416/244 |
| 55-134701 | 10/1980 | Japan . | |
| 88201 | 6/1982 | Japan | 416/244 |
| 91302 | 6/1982 | Japan | 416/244 |

OTHER PUBLICATIONS

"Ceramics for High-Performance Applications", pp. 415–424, Nov. 1973.

*Primary Examiner*—Robert E. Garrett
*Assistant Examiner*—John Kwon
*Attorney, Agent, or Firm*—Parkhurst & Oliff

[57] ABSTRACT

A radial-type ceramic turbine rotor comprising a blade member and a shaft bonded to the blade member, and having an axial hole extending through the blade member from its front surface towards the tip of the shaft, can be produced without forming cracks during dewaxing, ill-bonding of the blade member with the shaft, and lowering of the bonding strength, and has a high workability in the precise machining.

3 Claims, 2 Drawing Figures

RADIAL-TYPE CERAMIC TURBINE ROTOR AND A METHOD FOR PRODUCING THE SAME

This is a continuation of application Ser. No. 681,318, filed Dec. 13, 1984, now abandoned.

BACKGROUND OF THE INVENTION

1. Field of the Invention

The present invention relates to a radial-type ceramic turbine rotor and a method for producing the same.

2. Description of the Prior Art

Silicon ceramics, such as silicon nitride, silicon carbide, sialon and the like, are more stable than metal at high temperatures, and have high resistance against oxidation, corrosion and creep deformation. Therefore, there has been investigation into the utilization of silicon ceramics in engine parts. Particularly, a radial-type turbine rotor consisting of a ceramic material is lighter in weight than a metal rotor, can operate at a temperature higher than a metal rotor, and has better heat efficiency than a metal rotor. Therefore, radial-type ceramic turbine rotors have recently become attractive as a turbo-charger rotor for automobiles, gas-turbine rotors and the like.

There has hitherto been known a radial-type ceramic turbine rotor disclosed in Japanese Patent Laid-open Specification No. 88,201/82, which corresponds to U.S. Pat. No. 4,544,327. This turbine rotor has been produced by a method, wherein a blade member 1 having a complicated three-dimensional shape is formed from ceramics, for example, by an injection molding; a shaft 2 is produced by means of a rubber press from a green body of the shaft, which has been obtained from ceramics, for example, by means of a metal mold press; and the resulting blade member 1 and shaft 2 are conically fitted and bonded to each other, and the bonded article is fired to form a monolithic ceramic turbine rotor as illustrated in FIG. 2. However, the ceramic turbine rotor produced by the method disclosed in this prior art has drawbacks that (1) cracks are likely to form during the dewaxing step in the large thickness portion of a shaped article for blade member produced by the injection molding; (2) it is necessary to match exactly the shape of the blade member with that of the shaft at their portion, and when their shapes are not matched with each other, gaps and other bondings defects occur in the bonding interface, and moreover the thickness of the paste applied to the bonding interface is apt to be ununiform, resulting in a decrease of the bonding strength; and (3) it is difficult to determine the center hole of a fired rotor during precision machining thereof, and the fired rotor is poor in workability, and the like.

SUMMARY OF THE INVENTION

An object of the present invention is to eliminate the above described drawbacks in the conventional ceramic turbine rotors comprising a blade member and a shaft, and to prevent the formation of cracks in the large thickness portion of the blade member during the dewaxing step which occurs in the production of the turbine rotors.

Another object of the present invention is to bond easily the blade member to the shaft, to prevent the ill-bonding, such as formation of gaps or the like, at the bonding interface, to form uniform bonding layer of ceramic paste, and to increase the bonding strength.

A further object of the present invention is to utilize the axial hole, formed in the front surface of the blade member, during the final machining of a fired ceramic turbine rotor as a center hole, and to improve the workability of the turbine rotor.

That is, one of the features of the present invention lies in a radial-type ceramic turbine rotor, comprising a blade member and a shaft bonded to the blade member at the center portion of the blade member, and having an axial hole extending through the blade member from its front surface towards the tip of the shaft.

Another feature of the present invention lies in a method of producing a radial-type ceramic turbine rotor comprising a blade member and a shaft fitted to the blade member by substantially conical concave and convex portions, the improvement comprising forming a blade member having an axial hole extending therethrough from its front surface towards the tip of the shaft, said axial hole having a gradually increasing or decreasing diameter within the range of 2–5 mm after firing between the front surface of the blade member and the tip of the shaft, the axial hole being tapered from the front surface of the blade member towards the tip of the shaft or is reversely tapered at an angle of maximum 5°, preferably not larger than 2°, with respect to the center axis of the rotor; separately forming a shaft; machining the blade member and the shaft so that they can be fitted together by substantially conical concave and convex portions; contacting tightly the blade member and the shaft at the concave and convex portions through a ceramic paste; and firing the resulting assembly under atmospheric pressure.

DESCRIPTION OF THE PREFERRED EMBODIMENT

Figure 1:
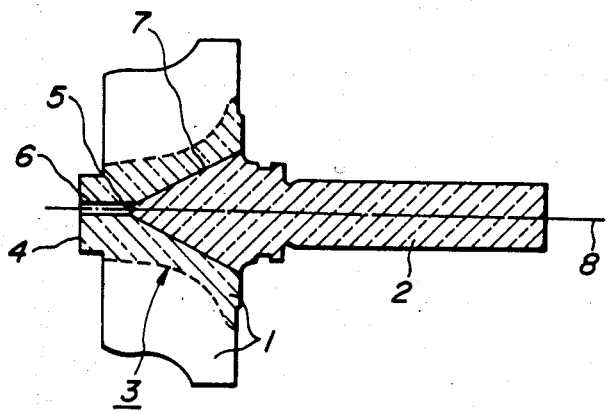
FIG. 1 is a cross-sectional view of one embodiment of a radial-type ceramic turbine rotor of the present invention.
Figure 2:
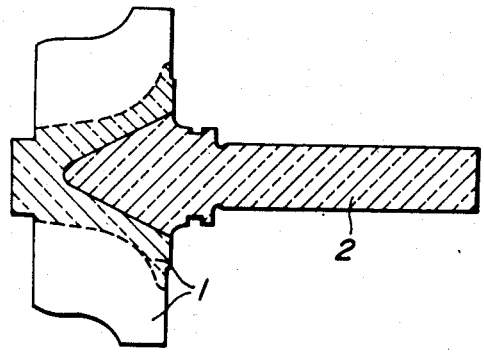
FIG. 2 PRIOR ART
FIG. 2 is a cross-sectional view of a conventional radial-type ceramic turbine rotor.

The present invention will be explained in more detail by referring to the drawings.

Referring to FIG. 1, the radial-type ceramic turbine rotor of the present invention comprises a blade member 1 and a shaft 2 bonded to the blade member 1 at the center portion 3 of the blade member 1, the blade member 1 having an axial hole 6, extending through the blade member 1 from its front surface 4 towards the tip 5 of the shaft 2. In the radial-type ceramic turbine rotor, the blade member 1 and the shaft 2 are bonded together substantially by the fitting of the conically concave female surface in the blade member 1 and a convex male surface on the shaft 2. The axial hole 6 is preferably tapered at an angle smaller than the tapered angle of the cone of the bonding surface 7. The axial hole 6 has a gradually increasing or decreasing diameter between the front surface 4 of the blade member 1 and the tip 5 of the shaft 2, and has a diameter of 2–5 mm at the front surface 4 of the blade member and at the tip 5 of the shaft, and is tapered from the front surface 4 of the blade member towards the tip 5 of the shaft or is reversely tapered at an angle of maximum 5°, preferably not larger than 2°, with respective to the center axis 8 of the rotor.

The production method of the radial-type ceramic turbine rotor of the present invention will be explained.

Powdered ceramics, such as silicon nitride, silicon carbide, sialon or the like, is kneaded together with a sintering aid, such as $Y_2O_3$, MgO, $CeO_2$, SrO, BeO, B, C or the like, to produce a homogeneous mixture. Then, the mixture is kneaded together with a binder, such as resin, wax or the like, under application of heat to produce a ceramic raw material for injection molding. The ceramic raw material is injection molded into a shaped article for the blade member 1 by means of a metal mold which has been adjusted such that the metal mold can mold a blade member 1 having an axial hole 6 as illustrated in FIG. 1, which axial hole 6 extends through the blade member 1 from its front surface 4 towards the tip 5 of the shaft, the axial hole 6 having a gradually increasing or decreasing diameter within the range of 2–5 mm after firing between the front surface 4 of the blade member and the tip 5 of the shaft, and is tapered from the front surface 4 of the blade member towards the tip 5 of the shaft or is reversely tapered at an angle of maximum 5°, preferably not larger than 2°, with respect to the center axis 8 of the rotor. Alternatively, the above described axial hole 6 is formed by means of a cemented drill or the like in a shaped article produced by an injection molding, whereby a shaped article for blade member 1 having the above described axial hole 6 is produced. Then, the shaped article is dewaxed by heating it in an electric furnace to remove binders, such as resin, wax and the like, which are contained in the shaped article due to injection molding. The heating condition must be varied depending upon the kind and amount of resin, wax and the like contained in the shaped article, but generally the rate of raising the temperature up to 500° C. is not greater than 100° C./hr, and preferably the rate of raising the temperature up to 300° C. is not greater than 10° C./hr.

Separately, a shaped article for the shaft 2 is formed from the above described ceramic raw material by a conventional method for forming a ceramic article, such as injection molding, slip casting, metal mold pressing, isostatic pressing or the like. In this case, it is not always necessary that the shaped article the blade member and the shaped article the shaft are made from the same ceramic raw material. However, the use of the same ceramic raw material in these shaped articles is preferable due to the small difference in thermal expansion between both of the shaped articles. The shaped blade member and the shaped shaft article are calcined at 800°–1,200° C., and mechanically worked such that a conical concave and convex fitting is formed at the bonding surfaces 7 on both of the shaped articles. In this case, it is preferable that the tip 5 of the shaft goes into the axial hole 6. Therefore, although the tip 5 may be a conical tip, the tip 5 may be formed into a round shape having a radius of curvature of about 2–5 mm, thereby having a diameter which is the same as the diameter of the axial hole 6. After a heat-resistant ceramic paste, preferably made of the same material as that of the blade member 1 and shaft 2, is applied to the bonding surfaces 7 of the shaped blade member and the shaped shaft, article, and then both of the shaped articles are tightly contacted with each other. Both the shaped articles are bonded together only at the conical concave and convex portions constituting the bonding surface 7, and the tip 5 of the shaft goes into the axial hole 6. In this case, excessive paste applied to the bonding surface 7 flows into the axial hole 6, and hence a uniform paste layer is formed at the bonding surface 7, and a high bonding strength is obtained. The paste which flows into the axial hole 6 does not have an adverse influence upon the subsequent steps. Moreover, the axial hole 6 can still be effectively used as a center hole.

The assembly formed of the tightly contacted shaped articles is covered with an elastomer, such as latex rubber or the like, and subjected to isostatic pressing under a pressure of not greater than 5 ton/cm$^2$. Then, the resulting shaped article is fired under a temperature and an atmosphere, which are optimum for the blade member 1, the shaft 2 and the ceramic paste, to result in a strongly bonded monolithic ceramic rotor. Further, in order to produce a final product, the above described axial hole 6 is used as a center hole, and the blade member 1 and the shaft 2 are precisely machined to produce a radial-type ceramic turbine rotor as illustrated in FIG. 1.

The reason why the diameter of the axial hole 6 is limited to 2–5 mm in the present invention is that it is difficult to form an axial hole 6 having a diameter smaller than 2 mm in the blade member 1 during the formation of the blade member or after the formation thereof, and further an axial hole 6 having a diameter smaller than 2 mm does not fully act as an exhaust hole for binder during the dewaxing treatment; on the contrary, when the diameter of the axial hole 6 is larger than 5 mm, the contact area between the blade member and the shaft is small, and there is a risk that the shaft will begin to break from its tip 5. When the diameter of the axial hole 6 is within the range of about 2–5 mm, the shaft does not break during high speed rotation of the rotor.

Turbine rotors are generally subjected to a maximum stress at that portion of a shaft 2 which is fitted into the blade member 1. However, in the turbine rotor of the present invention, this portion has a thickness larger than that of the blade member 1, and hence this portion can endure a high tensile stress caused by the high speed rotation of the rotor.

The reason why the tapered or diverged angle of the axial hole 6 is preferred to be maximum 5° is that, when the axial hole 6 is tapered or diverged at an angle of 5° or les, the object of the present invention can be satisfactorily attained, and the diameter of the axial hole is kept within the range of 2–5 mm at the tip 5 of the shaft.

The following examples are given for the purpose of illustration of this invention and are not intended as limitations thereof.

EXAMPLE 1

To 100 parts by weight (hereinafter, "parts" mean parts by weight) of $Si_3N_4$ particles having an average particle size of 1 μm were added 2 parts of SrO, 3 parts of MgO and 3 parts of $CeO_2$ as sintering aids to prepare a $Si_3N_4$ mixture for atmospheric pressure sintering. A part of this mixture was mixed with 15% by weight (hereinafter "%" means % by weight) of polyethylene wax and 2% of stearic acid, both the amounts being based on the total amount of the $Si_3N_4$ mixture, the polyethylene wax and the stearic acid, and the resulting mixture was heated and kneaded to prepare a ceramic raw material for injection molding. The resulting raw material was injection molded into a blade member 1 by means of a metal mold which has been adjusted such that the metal mold was able to produce the blade member 1 of a radial-type turbine rotor, which blade member 1 had a maximum diameter of 50 mm and had an axial hole 6 having a diameter of 2 mm at the front surface 4 of the blade member 1 and being diverged from the front surface 4 of the blade member towards the tip 5 of the shaft 2 at an angle of 5° with respect to the center axis of the rotor. The resulting blade member 1 was heated up to 400° C. in an electric furnace at a temperature-raising rate of 3° C./hr and held at 400° C. for 5 hours to be dewaxed. After the dewaxing, no cracks were observed in any portions of the blade member.

Another part of the above described $Si_3N_4$ mixture was fully kneaded together with 2% of polyvinyl alcohol, the amount of the polyvinyl alcohol being based on the total amount of the $Si_3N_4$ mixture and the polyvinyl alcohol, and the resulting mixture was press molded by means of a metal mold, and the shaped article was isotropically compressed by means of a rubber press to produce a shaped article for shaft. The shaped article was machined into a conical shape at its tip by means of a lathe to produce a shaft 2.

Each of the bonding surfaces 7 of the resulting blade member 1 and shaft 2 was machined into a smooth surface by means of a lathe, and a paste consisting of $Si_3N_4$ powder containing 4 parts of MgO, 3 parts of SrO and 4.5 parts of $CeO_2$ was applied onto each bonding surface 7 in an amount that a film having a thickness of 100 μm would result after firing, and then the blade member 1 and the shaft 2 were tightly contacted with each other. The resulting assembly was wholly covered with a latex rubber, and subjected to an isostatic press have a pressure of 2 ton/cm$^2$ to obtain a shaped article having a monolith structure formed of a strongly bonded blade member 1 and shaft 2. Then, the shaped article was fired at 1,720° C. for 30 minutes in a nitrogen atmosphere. Then, the axial hole 6 formed in the front surface of the blade member 1 was used as a center hole, and the fired article was precisely machined by means of a lathe to obtain a radial-type ceramic turbine rotor as showin in FIG. 1.

In order to perform a spin test of the resulting ceramic rotor, the rotor portion was made to have an unbalance of 0.005 g.cm, and a metal shaft was fitted to the rotor portion so as to remove the increased unbalance and to adjust the balance such that the total unbalance of the assembly would be 0.005 g.cm. Then, the rotor was subjected to a spin test by means of a spin tester while increasing gradually the rotation speed. The rotor did not break even at a rotating number as high as 220,000 rpm.

EXAMPLE 2

To 100 parts of SiC powder consisting essentially of β-phase SiC and having an average particle size of 0.5 μm were added 3 parts of $B_4C$ and 2 parts of C as sintering aids to produce an SiC mixture for atmospheric pressure sintering. A portion of the resulting SiC mixture was mixed with 5% of EVA resin and 15% of polyethylene wax, the amounts of the EVA resin and the polyethylene wax being based on the total amount of the SiC mixture, the EVA resin and the polyethylene wax, and the resulting mixture was kneaded and simultaneously heated to produce a ceramic raw material for injection molding. The ceramic raw material was injection molded into a shaped article for blade member 1 of radial-type turbine rotor by means of a metal mold which had previously been adjusted such that a blade member 1 having a maximum diameter of 90 mm after firing could be obtained. An axial hole 6 was bored through the blade member-forming shaped article in its center portion by means of a cemented carbide drill such that the axial hole 6 had a diameter of 5 mm at the front surface 4 of the shaped article and decreased gradually towards the tip of a shaft. Then, the shaped article was heated up to 500° C. at a temperature-raising rate of 3° C./hr and held at 500° C. for 10 hours to remove the binder. No cracks were observed in the dewaxed blade member.

Another part of the above described SiC mixture was fully kneaded together with 2% of polyvinyl alcohol, the amount of the polyvinyl alcohol being based on the total amount of the SiC mixture and the polyvinyl alcohol, and the resulting mixture was press molded by means of a metal mold, and the shaped article was isotropically compressed by means of a rubber press to produce a shaped article for a shaft. The shaped article was machined into a conical shape at its tip by means of the lathe to produce a shaft 2.

Each of the bonding surfaces 7 of the resulting blade member 1 and the shaft 2 was machined into a smooth surface by means of a lathe, and a paste of SiC powder, which contained a sintering aid, in an amount that a film having a thickness of 100 μm would be formed after firing, was applied onto each bonding surface and then the blade member 1 and the shaft 2 were tightly contacted together. The resulting assembly was wholly covered with a latex rubber, and subjected to an isostatic press having a pressure of 3 ton/cm$^2$ to obtain a shaped article having a monolith structure formed of a strongly bonded blade member 1 and a shaft 2. Then, the shaped article was fired at 2,150° C. for 30 minutes argon atmosphere under atmospheric pressure. Then, the axial hole 6 formed in the front surface of the blade member 1 was used as a center hole, and the fired article was precisely machined by means of a lathe to obtain a radial-type ceramic turbine rotor, as shown in FIG. 1.

In order to perform a spin test of the resulting ceramic rotor, the rotor portion was made to have an unbalance of 0.02 g.cm, and a metal shaft was fitted to the rotor portion so as to remove the increased unbalance and to adjust the balance such that the total of the assembly would be 0.02 g.cm. Then, the rotor was subjected to a spin test by means of a spin tester while increasing gradually the rotation speed. The rotor did not break even at a rotating number as high as 100,000 rpm.

As described above, in the radial-type ceramic turbine rotor of the present invention, the blade member and the shaft are fitted to each other by substantially conical concave and convex portions, and an axial hole is formed through the blade member from its front surface towards the tip of the shaft, whereby the formation of cracks in the blade member during the dewaxing step can be prevented, the ill-bonding of the blade member with the shaft can be decreased, and the bonding strength between the blade member and the shaft can be increased. Moreover, the axial hole formed in the front surface of the blade member can be utilized in the machining of the ceramic rotor into the final shape, and the ceramic rotor has an improved workability. The ceramic rotor of the present invention can be produced very efficiently as compared with conventional ceramic rotors, and is very useful in industry.

What is claimed is:

1. A radial-type ceramic turbine rotor, comprising:

a blade portion having a front surface, a rear surface, a completely smooth conical female surface between said front and rear surfaces and an axial hole extending from said front surface toward said rear surface, said axial hole having a diameter of 2–5 mm and thereby functioning as an exhaust hole during a dewaxing of the rotor; and a shaft portion having a completely smooth conical male surface which is complementary to said conical female surface and a tip portion at an end of said shaft portion, said tip portion having a radius of curvature of 2–5 mm, said shaft portion being bonded to said blade portion such that said conical male surface contacts said conical female surface and said tip portion is the only portion of said shaft portion which commumicates with said axial hole and said tip portion is located completely within said blade portion such that said tip portion does not extend to said front surface of said blade portion.

2. The radial-type ceramic turbine rotor of claim 1, wherein said axial hole is tapered a maximum of 5 degrees and the largest portion of said hole is located adjacent said tip portion.

3. A radial-type ceramic turbine rotor, comprising:

a blade portion having a diameter of 50 mm–90 mm, a front surface, a rear surface, a completely smooth conical female surface between said front and rear surfaces and an axial hole extending from said front surface toward said rear surface, said axial hole having a diameter of 2–5 mm and being tapered a maximum of 5 degrees and the largest portion of said hole is located closest to said rear surface of said blade portion, said axial hole thereby functioning as an exhaust hole during a dewaxing of the rotor; and a shaft portion having a completely smooth conical male surface which is complementary to said conical female surface and a tip portion at the end of said shaft portion, said tip portion having a radius of curvature of 2–5 mm, said shaft portion being bonded to said blade portion such that said conical male surface contacts said conical female surface and said tip portion is the only portion of said shaft portion which communicates with said axial hole and said tip portion is located completely within said blade portion such that said tip portion does not extend up to said front surface of said blade portion.

* * * * *